US006695531B1

(12) United States Patent
Prescott

(10) Patent No.: US 6,695,531 B1
(45) Date of Patent: Feb. 24, 2004

(54) CONCRETE SLUMPING IMPLEMENT

(76) Inventor: Thomas Prescott, 239 N. Fox Ave., Panama City, FL (US) 32404

( * ) Notice: Subject to any disclaimer, the term of this patent is extended or adjusted under 35 U.S.C. 154(b) by 0 days.

(21) Appl. No.: 10/157,709

(22) Filed: May 30, 2002

(51) Int. Cl.[7] ..... E01C 19/22
(52) U.S. Cl. ..... 404/118; 404/97
(58) Field of Search ..... 404/118, 114, 404/97, 96; 15/235.4, 235.8; 37/265, 284, 285

(56) References Cited

U.S. PATENT DOCUMENTS

| | | | | | |
|---|---|---|---|---|---|
| 3,264,668 | A | * | 8/1966 | Lasker | 15/105 |
| 3,936,210 | A | * | 2/1976 | Oehlerking | 404/89 |
| 4,397,581 | A | * | 8/1983 | Jarvis | 404/97 |
| 4,723,869 | A | * | 2/1988 | Dragich | 404/97 |
| 4,838,730 | A | * | 6/1989 | Owens | 404/114 |
| 4,848,961 | A | * | 7/1989 | Rouillard | 404/114 |
| 4,861,188 | A | * | 8/1989 | Rouillard | 404/75 |
| 5,375,942 | A | * | 12/1994 | Lindley et al. | 404/97 |
| 5,605,415 | A | * | 2/1997 | Shamblin | 404/118 |
| 5,609,437 | A | * | 3/1997 | Silva | 404/118 |
| 5,687,448 | A | * | 11/1997 | Dye, Jr. | 15/235.8 |
| 5,727,279 | A | * | 3/1998 | Pike, Jr. | 15/235.4 |
| 6,089,787 | A | * | 7/2000 | Allen et al. | 404/118 |
| 6,374,569 | B1 | * | 4/2002 | Suckow | 52/729.13 |
| 6,379,080 | B1 | * | 4/2002 | Saffo, Sr. | 404/118 |

FOREIGN PATENT DOCUMENTS

| | | | | | |
|---|---|---|---|---|---|
| GB | 2231075 | A | * | 2/1990 | E01C/19/44 |
| GB | 2228759 | A | * | 9/1990 | E01C/19/44 |
| WO | WO 9102845 | A | * | 3/1991 | F01C/19/40 |

* cited by examiner

*Primary Examiner*—Robert E. Pezzuto
*Assistant Examiner*—Alexander K. Pechhold
(74) *Attorney, Agent, or Firm*—William B. Noll

(57) ABSTRACT

The combination of a hand held mounting mechanism having an elongated tubular member containing a rotating shaft, where the elongated tubular member includes a cone-shaped bracket at a free end thereof, and a concrete slumping implement. Several embodiments are disclosed, where in each the implement comprises a concrete contacting plate, either flat and/or sectional, or contoured, an upstanding wall extending therefrom, and an L-shaped bracket for mounting to the cone-shaped bracket. Additionally, the rotating shaft may mount an eccentric wheel for imparting a vibrating or cyclic action to the concrete slumping implement.

7 Claims, 9 Drawing Sheets

CONCRETE SLUMPING IMPLEMENT

FIELD OF THE INVENTION

This invention is directed to the field of slumping or flowing of a cementatious material, i.e. concrete, more particularly to a single operator, hand held vibratory tool for tamping and smoothing such material on a flat walkway or even a contoured curb.

BACKGROUND OF THE INVENTION

The present invention relates to a hand held, single person operated slumping implement for tamping and smoothing a concrete form, such as a walkway or curb, where the implement, also termed a screed, mounts a rotating eccentric to effect a vibratory action when desired.

Typically, for constructing a flat walkway or curb, forms, such as 2×4, or 2×6 wooden boards, are positioned about the periphery for the walkway or curb. Thereafter, preferably on top of a prepared base of stone, for example, a quantity of concrete is deposited. That is, it is known to deposit cementitious materials, i.e. concrete, on a base, by supplying the material to a hopper or the like from which the material is dispensed and to strike off the surface of the material with a profile forming device which may be attached to the hopper or may be separate from it.

One known form of profile forming device comprises a plate which may be vibrated and which strikes off excess material to produce the required surface configuration. It is known to use a rotatable device which is arranged to roll over the material so as to displace excess material ahead of itself and to leave the required surface configuration behind it.

Surface forming devices of known types are disadvantageous in that their manner of operation tends to result in the material slumping or flowing from higher to lower regions after the device has passed with the result that the surface configuration is different from the desired shape.

Numerous screeds, tools used to smooth and level freshly poured concrete, employ vibratory action to tamp and smooth the concrete in the final finishing step. U.S. Pat. No. 4,340,351, describes a vibratory concrete screed requiring two operators which is used in the final finishing of concrete. U.S. Pat. No. 4,641,995, describes a vibratory concrete screed which rides on forms to screed narrow strips of concrete, such as walks. The screed thereof is mounted on the operator via a complicated harness counter-weighted frame and is powered by electricity thus requiring the manipulation of lengthy extension cords and having electrical power on site.

Further, there are various types of expensive, highly sophisticated and complex equipment have been available for simultaneously finishing a concrete surface and forming curbs on the sides of an area of concrete. In addition, various types of comparatively inexpensive concrete finishing equipment in the form of triangular truss screeds have been available in the past as well as numerous attachments and accessories for these devices. By way of example, U.S. Pat. No. 4,316,715, discloses a vibratory concrete screed having spaced apart front and rear screed blades in combination with numerous different types of accessories and attachments for finishing a concrete surface. The latter patent specifically discloses a vertically and laterally adjustable blade extension bracket for forming a step on the side surface of an area of concrete.

There is additional prior art on devices or systems for slumping or forming concrete as reflected in the following U.S. Patents:

a.) U.S. No. 5,997,270, to LaBonte, relates to a flexible automated trowel for a sliding formwork machine to allow finishing of a continuous trapezoidal wall of the type having one rectangular side and one side inclined towards the top or with two angular sides. A mold supporting the trowel comprises two straight sides, an enlarging setback originating from a formwork line. A driveway cutter proceeds from the enlarging setback in the direction of the slope of the angular wall. The cutter may have a concave face which is to be placed against a moldable face to produce a superior convex face to the continuous wall. Materials like concrete for curbs, gutters, driveway entrances may be continuously poured and necessitate little or no finishing touches.

b.) U.S. Pat. No. 5,540,519, to Weber, teaches an extremely light-weight, portable floating power vibratory concrete "Wet Screed", which is hand operated by a single finisher in order to strike off, tamp and smooth freshly poured concrete using only perimeter slab forms or curbs. The unique angular design of the enclosed hollow screed blade allows the operator to lower the handle and effectively use the rear 60 degree angled surface of the screed blade to cut down the height of the concrete to the desired grade, or raise the handle to effectively use the front 60 degree angled surface of the screed blade to float and maintain the desired grade. The flat aluminum bottom extending from the front angled surface to the rear angled surface of the screed blade functions to produce a smooth, near final finish while the vibratory action tamps the rock down and works the moisture to the concrete surface, thereby substantially increasing the finishing time while making the finisher's job much easier.

c.) U.S. No. 4,544,346, to Allen, discloses apparatus that simultaneously finishes the surface of an area of concrete and forms a curb along one or both sides of the area as the apparatus is translated along the length of the area. The apparatus includes a vibratory concrete finishing machine, such as a triangular truss concrete screed, having first and second sides and spaced apart front and rear screed blades. The two sides of the finishing machine are supported by roller support units which engage each of the spaced apart forms. Coupling means connects the first roller support unit to the first side of the finishing machine, adjusts the lateral spacing between the first side of the finishing machine and the form, and adjusts the elevation of the screed blades with respect to the form. A curb form is coupled to the finishing machine between the form and the first side of the finishing machine.

d.) U.S. Pat. No. 4,391,549, to Murray, is directed to continuously extruding curb forming machines for roads that may be equipped with a downwardly moving sharpened blade for use in the insertion of an expansion joint piece at appropriate intervals into the curb without stopping the operation of the machine while the expansion joint piece is inserted. The expansion joint piece may be well known felt material for this purpose and the inserting blade has a template attached thereto the surface of which conforms to the surface of the curb and thus to the surface of the expansion joint piece. As the blade moves into the partially cured concrete, the template forces the joint piece into the same concrete.

e.) U.S. Pat. No. 4,097,173, to Tout, relates to a machine having a frame, supported by wheels, where the frame supports three spaced-apart self-placing form units, which operate in conjunction with finishing rollers. The self-placing form units of the machine are faced with endless synthetic rubber belts, which are backed up by hinged steel pads, and the top and bottom of the self-placing form units are sealed with a plate having a lip at the edge, to overlap the synthetic rubber, so as to repel any foreign matter, or concrete mix, from entering the inside of the units. The machine is reversible in direction when desired, and is used for concrete curb and gutter construction.

f.) U. S. Pat. No. 4,028,036, to Farfor, teaches a system for molding the surface of a moldable material, such as wet cement, to be shaped to a desired configuration by a profile forming device moved longitudinally relative to the material and rotated about an axis transverse to the direction of bodily movement. The profile forming device is eccentrically mounted or otherwise shaped to produce cyclic variation in level in the longitudinal direction and has a variable configuration along its length to provide a transverse variation in level of the surface. The profile forming device is driven at a speed to cause rubbing over the surface. It may also be moved bodily in a cyclic manner in the direction of its axis and/or away from and towards the surface.

SUMMARY OF THE INVENTION

This invention is directed to a concrete slumping implement that is light-weight and compact for handling by a single operator. The implement, of which there are a number of embodiments, is characterized by a concrete contacting plate, such as made of metal, a second upstanding wall secured along one edge thereof and angled generally perpendicular to said plate, and an L-shaped bracket adjustable to said second wall in one embodiment, and fixed in the remaining embodiments. One of the bracket legs is secured to the second wall while the other leg projects perpendicular to the second wall and contains an opening. For handling and operating the concrete slumping implement, said implement is mounted at the end of an elongated tubular member by means of a bracket secured to and overriding the opening in the second leg of the L-shaped bracket. The mounting mechanism, angled to the L-shaped bracket by an angle of less than 90°, is an engine operated device, such as by a gasoline engine, that is similar to a portable weeder or edger, but includes a rotating shaft within said tubular member. The free end of the rotating shaft extends through the bracket opening and receives an eccentric wheel, such that when rotated by operation of the engine the eccentric wheel will impart a vibrating or cyclic action to the concrete slumping implement.

One embodiment features a two part concrete contacting plate, where the parts may be adjustably angled to one another. The second wall may also be partitioned, where at least one of said partitioned sections include a pair of arcuate slots, whereby the L-shaped bracket can be adjusted relative to said at least one partitioned sections by sliding fastener members. This embodiment is particularly useful for constructing an angled curb, such as 10° to 20°, by way of example.

The remaining embodiments feature different shaped concrete contacting plates to form a variety of curb profiles for DOT approved road designs.

Accordingly, a feature of this invention is to provide a convenient and easily operated concrete slumping implement that can be readily adjusted for leveling along a flat surface, or angled to construct a curb.

A further feature hereof is the inclusion of an intermitently operated, powered eccentric wheel to impart a vibrating or cyclic action to the implement.

Still another feature of the invention is the provision of a concrete slumping implement having a contoured concrete contacting surface for easily constructing selected governmentally approved road designs.

BRIEF DESCRIPTION OF DRAWINGS

FIG. 7 is a perspective view of a second embodiment for a curb constructing slumping implement according to this invention, while

FIG. 8 is a perspective view of a third embodiment for a curb constructing slumping implement according to this invention, while

FIG. 9 is a perspective view of a fourth embodiment for a curb constructing slumping implement according to this invention, while

FIG. 10 is a perspective view of a fifth embodiment for a curb constructing slumping implement according to this invention, while

DETAILED DESCRIPTION OF PREFERRED EMBODIMENT

Figure 1:
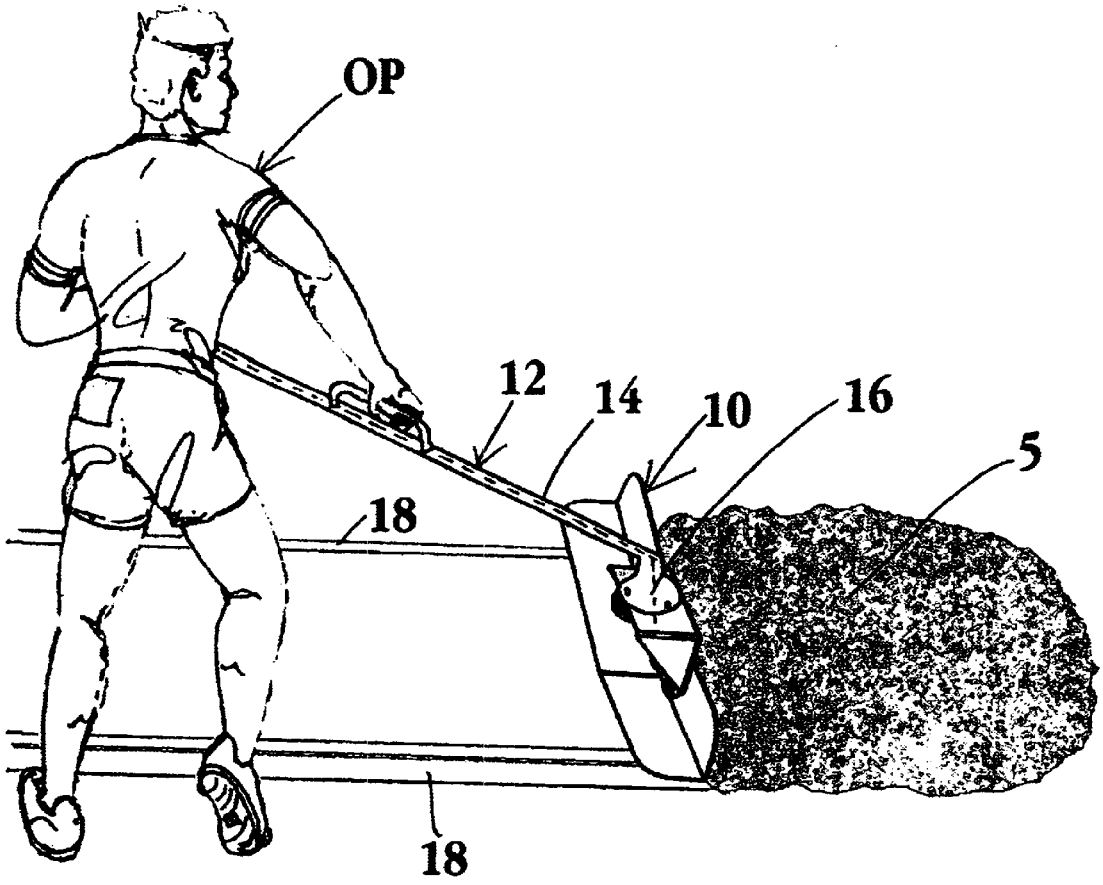
FIG. 1 is a perspective view of the concrete slumping implement according to this invention, showing the manner of using same in slumping or leveling wet concrete between a pair of forms, where the implement hereof may be maneuvered by a single operator.
Figure 2:
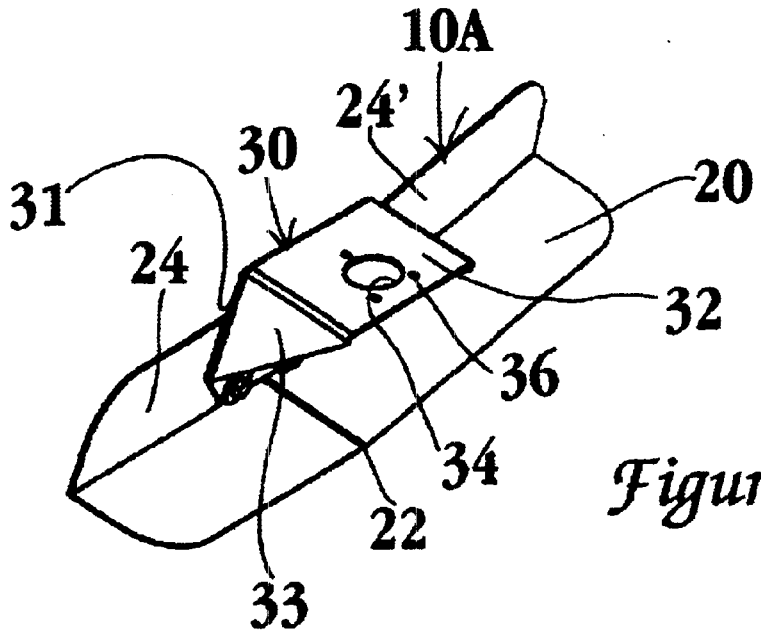
FIG. 2 is a perspective view of a first embodiment for an adjustable concrete slumping implement in accordance with the invention.
Figure 5A:
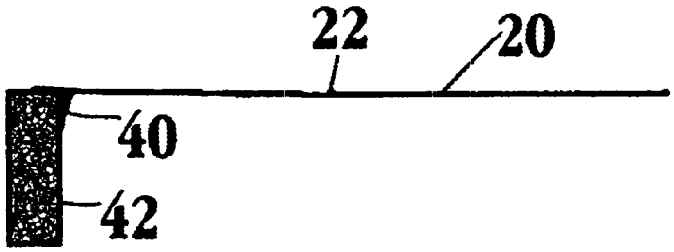
FIGS. 5A, 5B and 5C illustrating, respectively, the concrete profile formed by the adjustable concrete implements of FIGS. 3A, 3B and 3C.
Figure 5B:
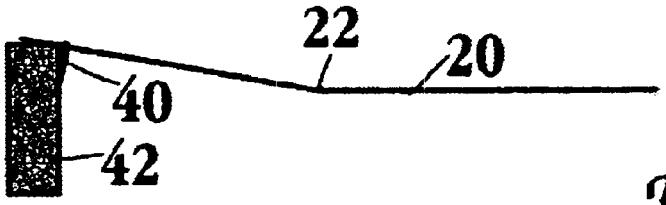
Figure 5C:
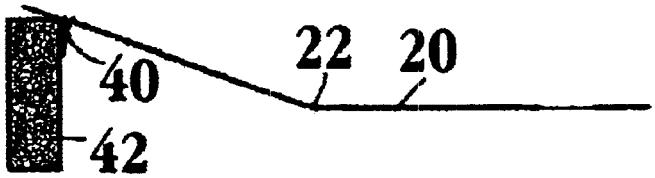

The invention, illustrated in the several embodiments in FIGS. 1–10A, is a construction aid in the form of concrete slumping implements, where the implement may be adapted for constructing contoured curbs or flat surfaces, and has the capability to be cyclic vibrated. The implement is light-weight and compact, and can be easily operated by a single person. The several embodiments for the invention will now be described with regard to the different Figures, where like reference numerals represent like components or features throughout the various views.

Turning first to FIG. 1, the concrete slumping implement 10 is illustrated in an operative mode, where the concrete slumping implement is shown attached to a hand held mounting mechanism 12 for handling by an operator "OP". Before continuing with details of the concrete slumping implement 10, it will be understood that the mechanism 12 is comparable to a conventional, hand held, gasoline powered, grass edger that includes an engine (not shown), and an elongated fixed shaft or tubular member 14 receiving a rotating shaft (not shown). The free or remote end of the fixed shaft includes a cone shaped bracket 16 for attaching the concrete slumping implement 10, as later discussed. Note that the operator "OP" is positioned outside the area to be treated, i.e. outside the perimeter frame members 18, where said frame members are conventional and typically comprise 2×4 or 2×6 wooden boards. The operator, offset from the work area, is achieved by angling the tubular member 14 from the concrete slumping implement 10. In other words, the tubular member is angled less than 90° from the plane formed by the concrete slumping implement 10. In the operating mode, where the implement may include the capability of imparting a vibrating or cyclic action to the implement, as discussed later, the operator "OP" moves the implement 10 back and forth along the frame members 18 to spread and level the concrete from the deposited slump "S".

FIGS. 2 through 6 illustrate different views and profiles for an adjustable concrete slumping implement 10A according to the present invention. This first embodiment for the implement comprises a two sectioned, flat surfaced, concrete contacting plate 20, such as made of metal, where the sections may be separate parts or hinged along a common edge 22. Upstanding from the concrete contacting plate are a pair of walls 24, 24', where a first said wall 24 includes a pair of arcuate slots 26, while the second said wall 24' includes a pair of apertures 28. For mounting to said walls 24, 24' is an L-shaped bracket 30, where said bracket features a first leg 31 for attaching to said walls 24, 24', see FIG. 4, a second leg 32 having a central opening 34 of a size to receive the rotating shaft of the mounting mechanism, and preferably a pair of triangular side supports 33. Additionally, the second leg 32 includes plural fastener receiving openings 36 for attaching the cone shaped bracket 16, as discussed above. Finally, as best seen in FIGS. 3A through 3C, the lower surface 38 includes a downwardly extending pin projection 40 that facilitates moving the concrete slumping implement against a frame member 18. Specifically, the implement is positioned such that the pin projection 40 rides against the inner surface 42 of the frame member 18, see FIG. 5A through 5C.

Figure 3A:
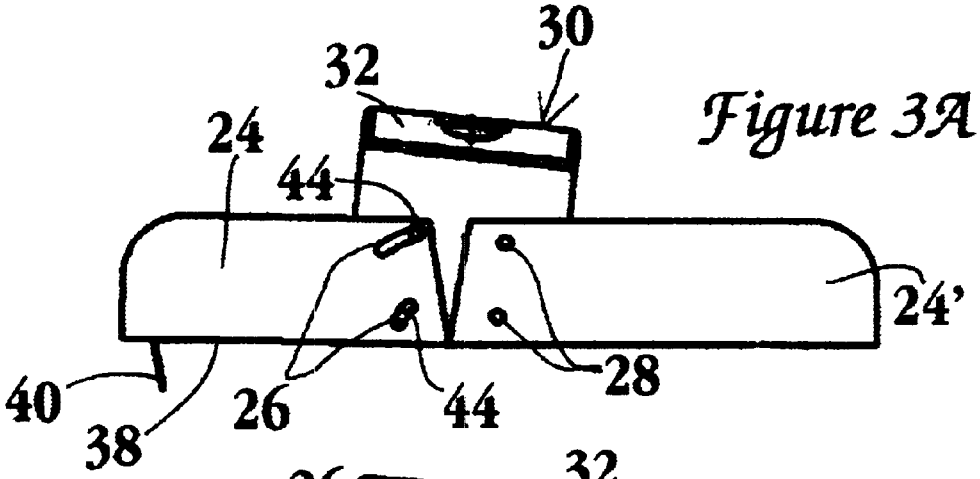
FIGS. 3A, 3B and 3C are front views of the adjustable concrete slumping implement of FIG. 1, showing respectively, flat such as for leveling a walkway, angled about 10° for forming a curb, and angled about 20° for a steeper curb.
Figure 3B:
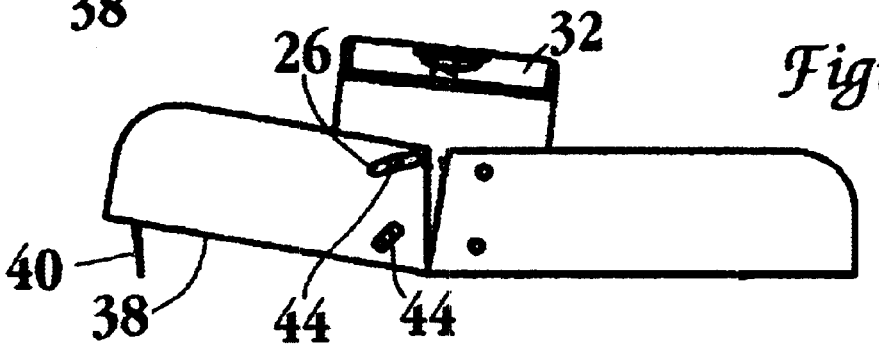
Figure 3C:
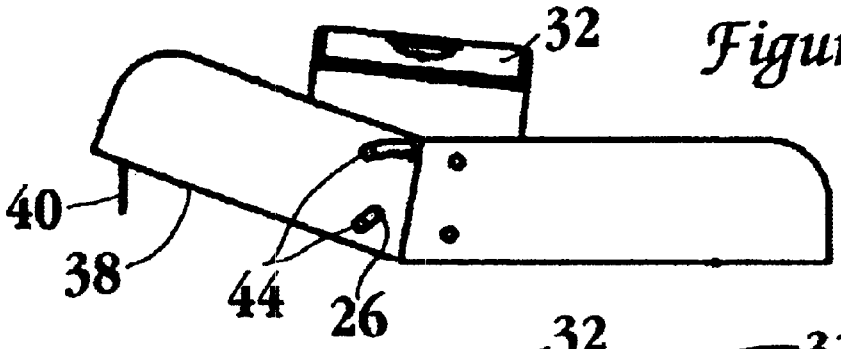
Figure 4:
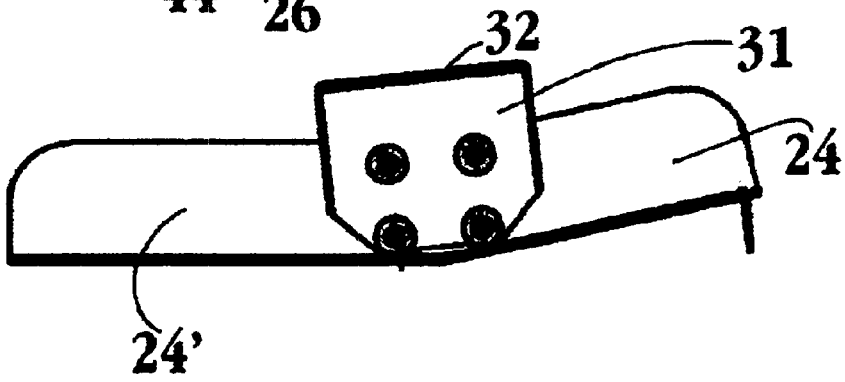
FIG. 4 is a rear view of the adjustable concrete slumping implement of FIG. 3B.

The adjustable feature of the first embodiment for the implement 10A of this invention is best illustrated in FIGS. 3A through 3C, and the respective profiles 5A through 5C. The profiles, ranging from 0° in FIGS. 3A and 5A, to a slight angle of about 10° in FIGS. 3B and 5B, to a larger angle of about 20°, where simply moving the fastener members 44 along the arcuate slots 26 and tightening same will position the implement 10A to the desired angle.

Figure 6:
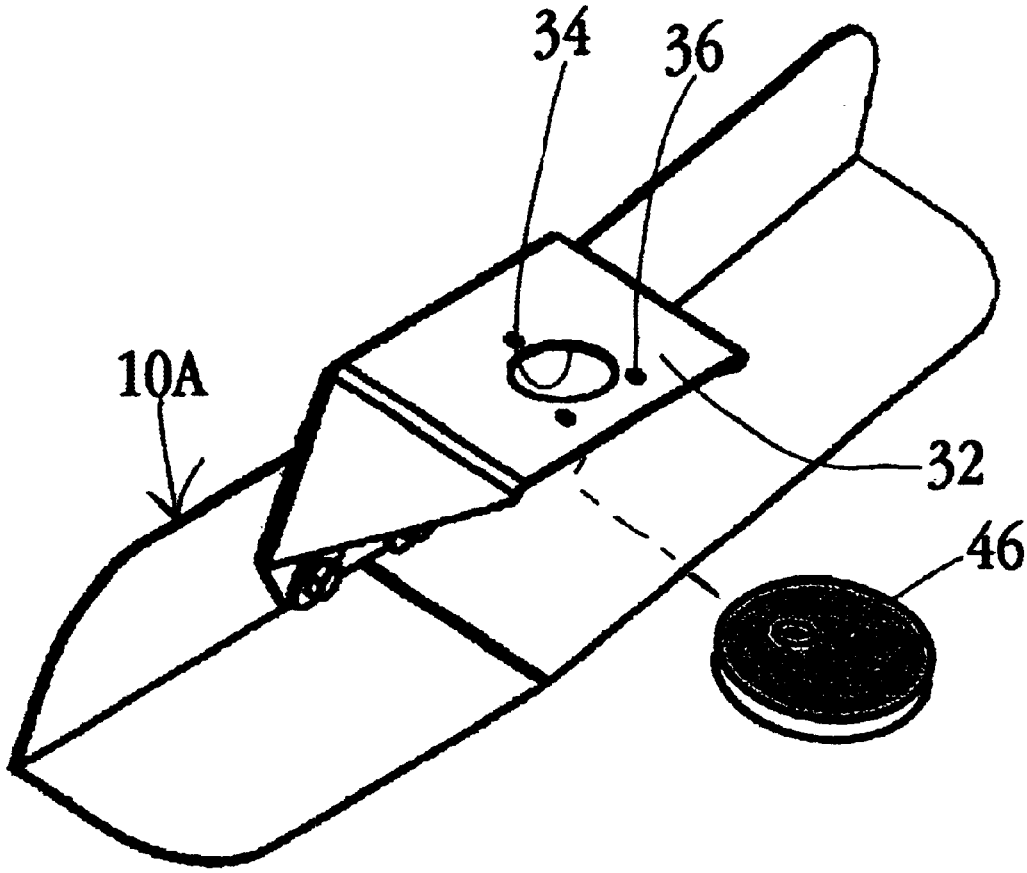
FIG. 6 is an exploded perspective view of the adjustable slumping implement, similar to FIG. 2, showing further an eccentric wheel for use in combination with said implement.
Figure 7:
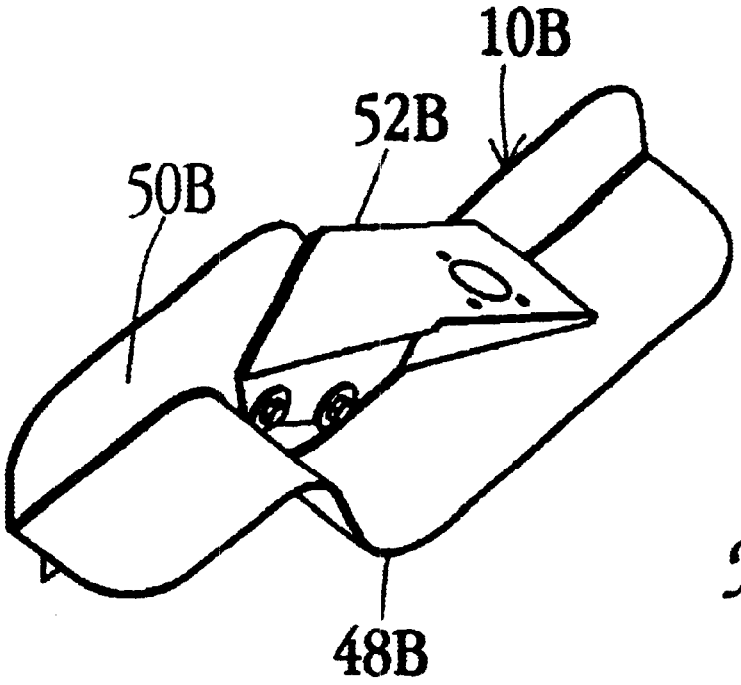
Figure 7A:
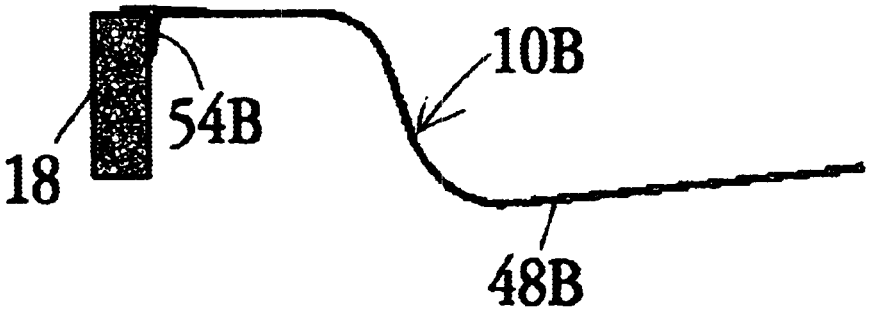
FIG. 7A is a profile of the concrete using same.
Figure 8:
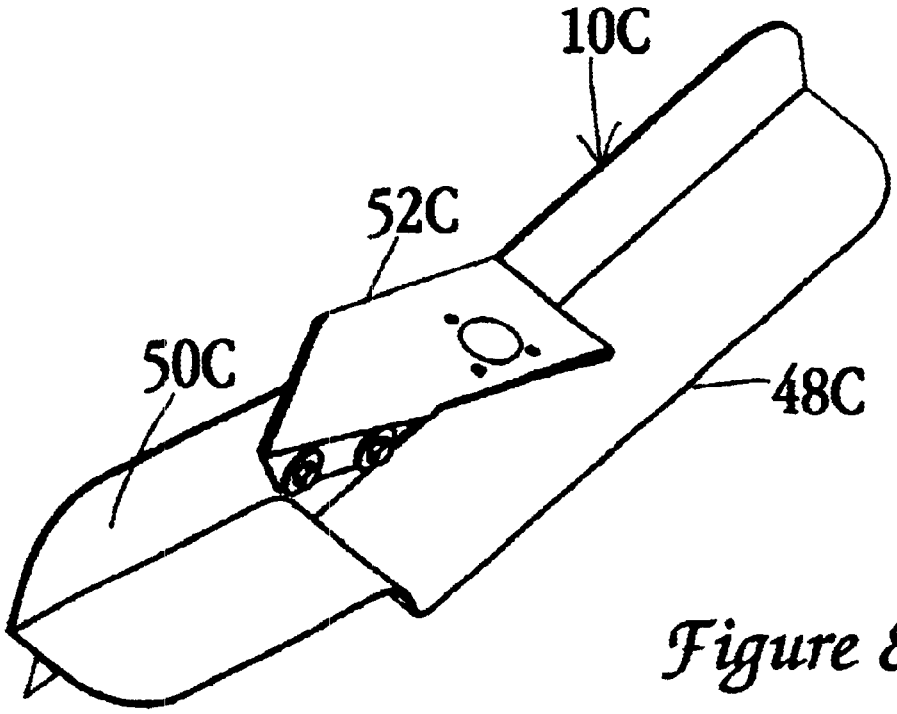
Figure 8A:
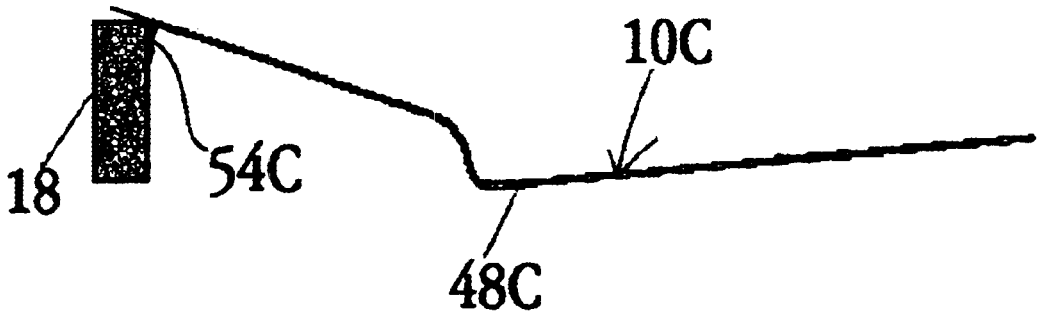
FIG. 8A is a profile of the concrete using same.
Figure 9:
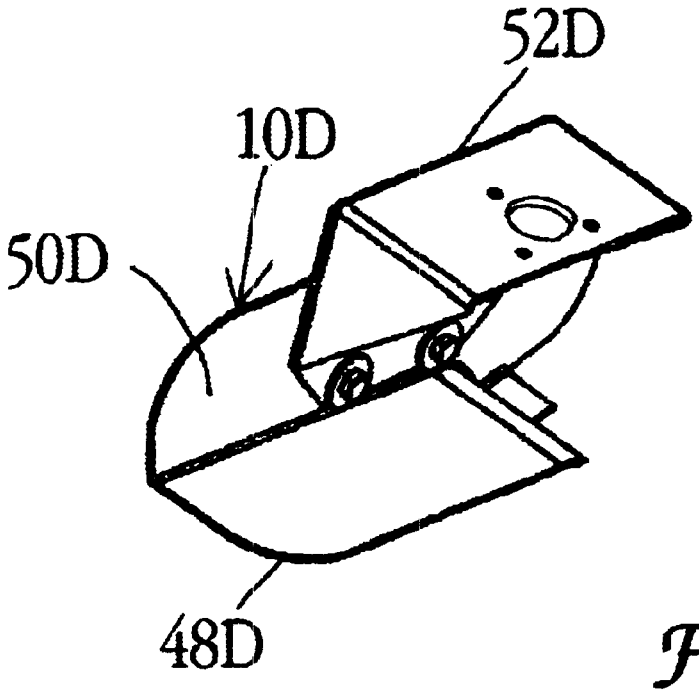
Figure 9A:
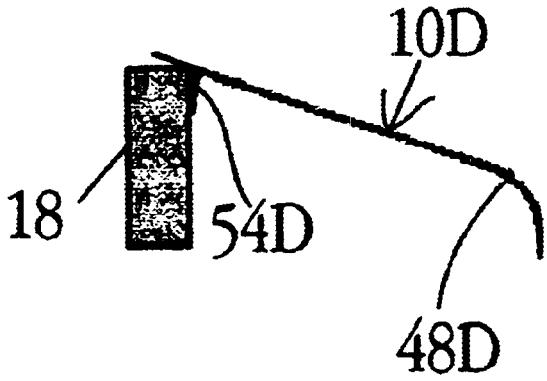
FIG. 9A is a profile of the concrete using same.
Figure 10:
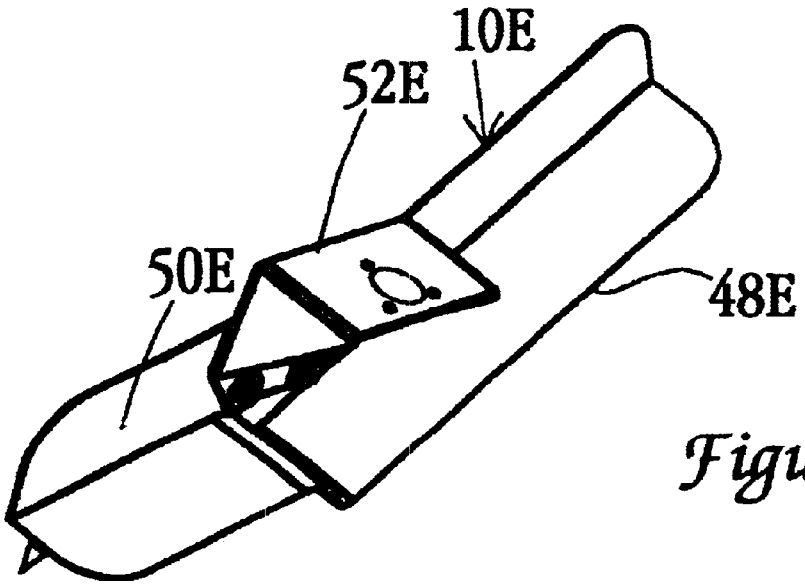
Figure 10A:
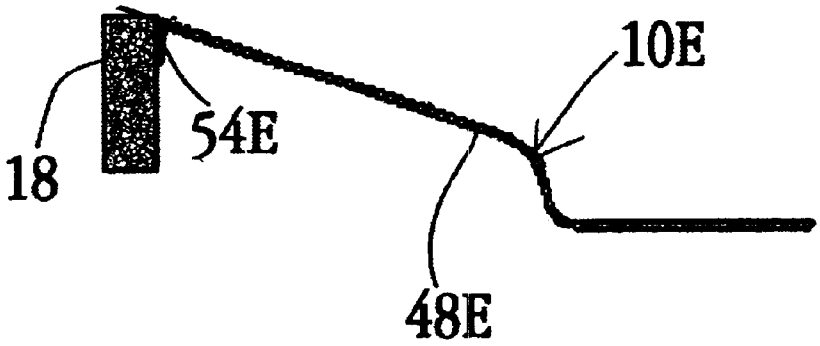
FIG. 10A is a profile of the concrete using same.

As noted previously, the concrete slumping implement has the ability to impart a vibrating or cyclic motion to the implement. This is achieved by the attachment of an eccentric wheel 46, see FIG. 6, to the end of the rotating shaft at a position below the second leg 32. FIG. 6 shows the eccentric wheel 46 offset, but with a dotted line indicating the manner of positioning the wheel for attachment to the rotating shaft.

FIGS. 7 through 10A illustrate several fixed concrete slumping implements 10B, 10C, 10D and 10E, where the respective implements reveal profiles that conform to approved curb shapes. That is, the DOT departments of each State have approved various curb shapes, where the illustrated profiles represent approved curb shapes by the State of Florida Department of Transportation Road design. Each of said curb profiles include a shaped base plate or concrete contacting surface 48B, 48C, 48D and 48E. Further, the respective implements include upstanding walls 50B, 50C, 50D and 50E from an edge thereof, where the walls mount an L-shaped bracket 52B, 52C, 52D and 52E, in a manner described above.

Further, as shown in the respective profiles, each implement 10B, 10C, 10D and 10E feature a downwardly directed pin projection 54B, 54C, 54D and 54E for riding along the frame member 18.

Figures 11A, 11B, 11C:
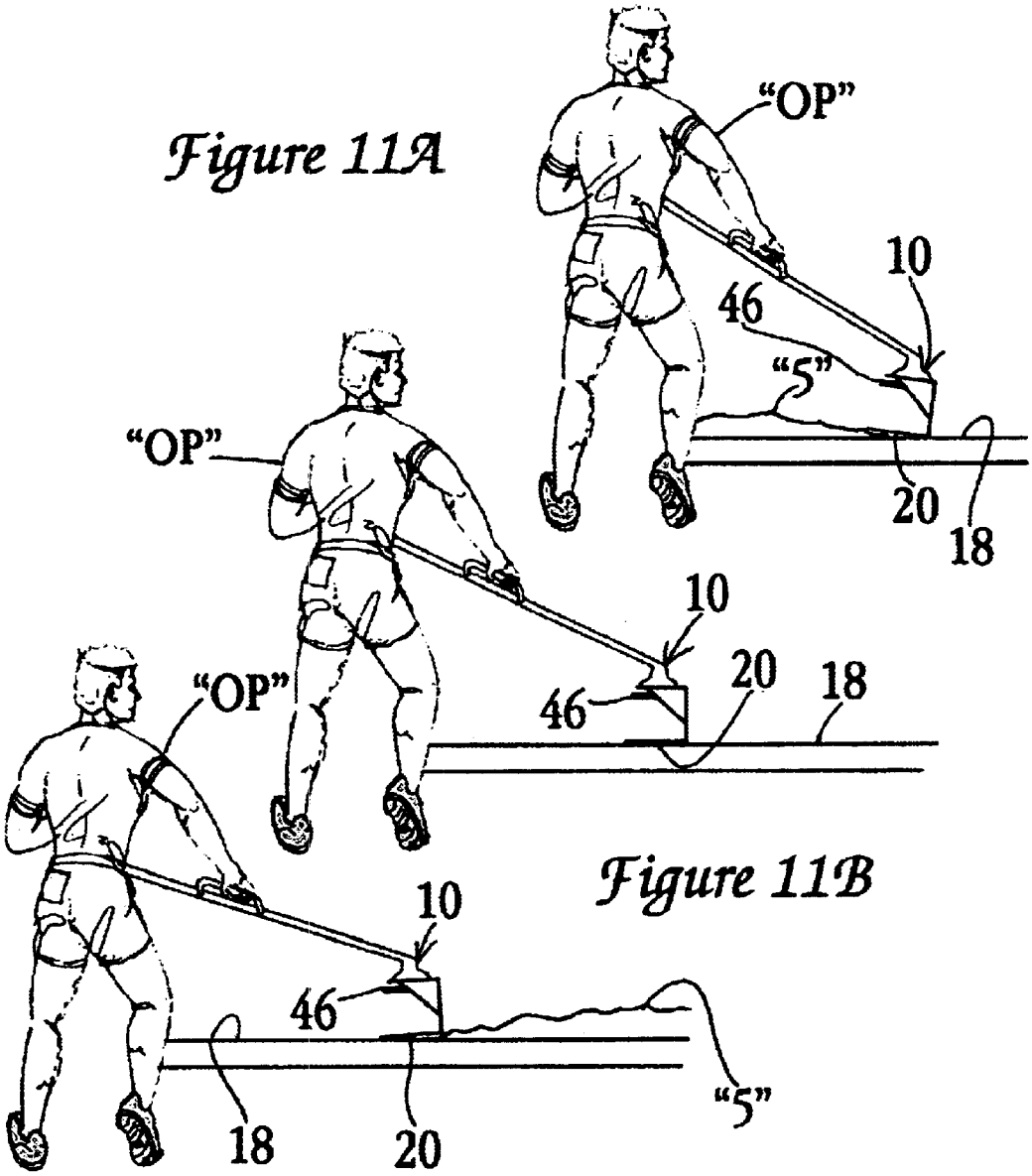
FIGS. 11A through 11C are perspective views illustrating three operating sequences for the concrete slumping implement of this invention.

FIGS. 11A through 11C illustrate three exemplary operating positions for using the implement 10 by an operator "OP" in leveling a concrete walkway or curb form. Specifically, FIG. 11A shows the operator pulling the implement 10 towards himself, with the concrete contacting plate 20, for example, angled slightly upwardly and rearwardly into the concrete slump "S" to spread and reduce the rear concrete slump. The next Figure, FIG. 11B, shows the operator "OP" leveling and smoothing the concrete, with the concrete contacting plate flat against the smoothing surface of the concrete, preferably with the oscillating eccentric wheel 46 rotating. Finally, in FIG. 11C, the operator "OP" is shown, with the implement angled slightly upwardly and forwardly, pushing against the concrete slump "S" to spread and reduce the forward slump between the frame members 18.

It is recognized that changes, variations and modifications may be made to the several embodiments for the concrete slumping implements of this invention, especially by those skilled in the art, without departing from the spirit and scope thereof. Accordingly, no limitation is intended to be imposed on this invention, except as set forth in the accompanying claims.

I claim:

1. In combination with a hand held mounting mechanism featuring an elongated tubular member within which is a shaft for rotating movement, means for rotating said shaft, and a remote end on said shaft receiving a cone-shaped bracket for fixedly mounting a concrete slumping implement and an opening through which a free end of said rotating shaft projects, a concrete slumping implement for slumping and screeding a cementatious material, said implement comprising:

a concrete contacting plate with the capability to effect the simultaneous slumping and screeding of nonplanar areas of said cementatious material, said contacting plate having a first edge mounting a two-section generally perpendicular wall extending therefrom, an L-shaped bracket mounted on a first said section to said perpendicular wall and a second said section having means for fixedly mounting said cone-shaped bracket, where said second section further includes an opening for receiving said free end of said rotating shaft, and an eccentric wheel mounted to said free end of said rotating shaft, whereby rotation of said eccentric wheel imparts a vibrating action to said concrete contacting plate.

2. The combination according to claim 1, wherein said concrete contacting plate defines a plane, and said elongated tubular member is angled less than 90° to said plane.

3. The combination according to claim 2, wherein said concrete contacting plate is in two sections to allow for the angular movement of one section to the other.

4. The combination according to claim 3, wherein said two sections are hinged along a common edge.

5. The combination according to claim 2, wherein said concrete contacting plate is a curved piece for contouring a curb profile.

6. The combination according to claim 1, wherein said concrete contacting plate includes a lower face having a pin projection extending downwardly therefrom, where said pin projection may be used as a guide for moving said concrete slumping implement.

7. In combination with a hand held mounting mechanism featuring an elongated tubular member within which is a shaft for rotating movement, means for rotating said shaft, and a remote end on said shaft receiving a cone-shaped bracket for fixedly mounting a concrete slumping implement and an opening through which a free end of said rotating shaft projects, a concrete slumping implement for slumping and screeding a cementations material, said implement comprising:

a concrete contacting plate having a first edge mounting a generally perpendicular wall extending therefrom, said perpendicular wall consisting of a pair of planarly aligned sections, an L-shaped bracket mounted on a first said section of said perpendicular wall and a second said section having means for fixedly mounting said cone-shaped bracket, said first wall section including a pair of arcuate slots for selectively fixing complementary fastening members to said first leg of said L-shaped bracket, said second section including an opening for receiving said free end of said rotating shaft, while said second section is fixed to said first leg of said L-shaped bracket, whereby rotation of said eccentric wheel imparts a vibrating action to said contacting plate.

* * * * *